US006333099B1

(12) United States Patent
Strondl et al.

(10) Patent No.: US 6,333,099 B1
(45) Date of Patent: Dec. 25, 2001

(54) MULTILAYERED PVD COATED CUTTING TOOL

(75) Inventors: Christian Strondl, Uppsala; Torbjörn Selinder, Stockholm; Mats Sjöstrand, Kista, all of (SE)

(73) Assignee: Sandvik AB, Sandviken (SE)

( * ) Notice: Subject to any disclaimer, the term of this patent is extended or adjusted under 35 U.S.C. 154(b) by 0 days.

(21) Appl. No.: 09/206,967

(22) Filed: Dec. 8, 1998

(30) Foreign Application Priority Data

Dec. 10, 1997 (SE) ..... 9704631

(51) Int. Cl.[7] ..... B32B 9/00

(52) U.S. Cl. ..... 428/216; 51/307; 51/309; 407/119; 428/336; 428/697; 428/698; 428/699; 428/701; 428/702

(58) Field of Search ..... 428/216, 336, 428/697, 698, 699, 701, 702; 51/307, 309; 407/119

(56) References Cited

U.S. PATENT DOCUMENTS

| | | | |
|---|---|---|---|
| 4,346,123 | 8/1982 | Kaufmann . | |
| 4,619,866 | 10/1986 | Smith et al. . | |
| 4,643,951 * | 2/1987 | Keem et al. | 428/698 |
| 4,984,940 | 1/1991 | Bryant et al. . | |

(List continued on next page.)

FOREIGN PATENT DOCUMENTS

| | | |
|---|---|---|
| 252 205 | 12/1987 | (DE) . |
| 0 446 375 * | 9/1991 | (EP) . |
| 592 986 | 10/1993 | (EP) . |
| 701 982 | 9/1995 | (EP) . |
| 709 483 | 10/1995 | (EP) . |
| 2 048 960 | 4/1979 | (GB) . |

OTHER PUBLICATIONS

S. Kadlec et al., "Sputtering Systems with Magnetically Enhanced Ionization for Ion Plating of TiN Films ", J. Vac. Sci. Techn. A8(3), May/Jun. 1990, pp. 1318–1324.

H. Curtins, "Platit: A New Industrial Approach to Cathodic Arc Coating Technology ", Surface and Coatings Technology, 76–77 (1995), pp. 632–639 no month.

K. Akari et al., Reduction of Macroparticles During the Deposition of TiN Films Prepared by Arc Ion Plating, Surface and Coatings Technology, 43/44, (1990), pp. 312–323 no month.

L.E. McCandlish et al., "Processing and Properties of Nanostructured WC–Co", Nanostructured Materials, vol. 1, pp. 119–124, 1992 no month.

O. Zywitzki et al., "Effect of the Substrate Temperature on the Structure and Properties of $Al_2O_3$ Layers Reactively Deposited by Pulsed Magnetron Sputtering ", Surface Coatings Technology, 82 (1996), pp. 169–175 no month.

*Primary Examiner*—Archene Turner
(74) *Attorney, Agent, or Firm*—Burns, Doane, Swecker & Mathis, L.L.P.

(57) ABSTRACT

There is disclosed a cutting tool comprising a body of a sintered cemented carbide or cermet, ceramic or high speed steel on which at least on the functioning parts of the surface of the body, a thin, adherent, hard and wear resistant coating is applied. The coating comprises a laminar structure of refractory compounds in a polycrystalline, repetitive form, $(MLX/Al_2O_3)/(MLX/Al_2O_3)/(MLX/Al_2O_3)/(MLX/Al_2O_3)/\ldots$, where the alternating sublayers consist of metal nitrides (or carbides) and crystalline alumina of the alpha ($\alpha$)- and/or the gamma ($\gamma$) phase, preferably of metal nitrides and crystalline alumina of the gamma phase, and in said coating the sequence of individual layer thicknesses has no repeat period but is essentially aperiodic throughout the entire multilayered structure. The metal elements in the layers MLX are selected from Ti, Nb, Hf, V, Ta, Mo, Zr, Cr, W, Al and mixtures thereof. The total thickness of said multilayered coating is between 0.5 and 20 $\mu$m.

10 Claims, 1 Drawing Sheet

U.S. PATENT DOCUMENTS 5,587,233 12/1996 König et al. .
5,698,314 12/1997 Goedicke et al. .
5,783,295 * 7/1998 Barnett et al. ..... 428/216
5,879,823 * 3/1999 Prizzi et al. ..... 428/702
6,210,726 * 4/2001 Schiller et al. ..... 428/701

* cited by examiner

MULTILAYERED PVD COATED CUTTING TOOL

BACKGROUND OF THE INVENTION

The present invention describes a cutting tool for metal machining, having a substrate of cemented carbide, cermet, ceramics or high speed steel and, on the surface of said substrate, a hard and wear resistant refractory coating deposited by Physical Vapor Deposition (PVD). The coating is adherently bonded to the substrate and is composed of a laminar, multilayered structure of metal nitrides or carbides in combination with alumina ($Al_2O_3$), and with the metal elements of the to nitride or carbide selected from Ti, Nb, Hf, V, Ta, Mo, Zr, Cr, W, Al or mixtures thereof. The individual metal nitride (or carbide) and alumina layers have layer thicknesses in the nanometer (nm) range and the stacking of the layers is aperiodic with respect to individual layer thickness.

The process of depositing a thin refractory coating (1–20 $\mu$m) of materials like alumina, titanium carbide and/or titanium nitride onto a cutting tool body, e.g., cemented carbides or similar hard materials such as cermets, ceramics and high speed steels, is a well-established technology and the tool life of the coated cutting tool, when used in metal machining, is considerably prolonged. The prolonged service life of the tool may under certain conditions extend up to several hundred percent greater than that of an uncoated tool. Said refractory coatings generally comprise either a single layer or a combination of layers. Modern commercial cutting tools are characterized by a plurality of layer combinations with double or multilayer structures. The total coating thickness varies between 1 and 20 micrometers ($\mu$m) and the thickness of the individual sublayers varies between a few microns and a few tenths of a micron.

The established technologies for depositing such coatings are CVD and PVD (see, e.g., U.S. Pat. Nos. 4,619,866 and 4,346,123). PVD coated commercial cutting tools of cemented carbides or high speed steels usually have a single coating of TiN, TiCN or TiAlN, but combinations thereof also exist.

There exist several PVD techniques capable of producing refractory thin films on cutting tools. The most established methods are ion plating, magnetron sputtering, arc discharge evaporation and IBAD (Ion Beam Assisted Deposition). Each method has its own merits and the intrinsic properties of the produced coating such as microstructure/grain size, hardness, state of stress, cohesion and adhesion to the underlying substrate may vary depending on the particular PVD method chosen. An improvement in the wear resistance or the edge integrity of a PVD coated cutting tool being used in a specific machining operation can thus be accomplished by optimizing one or several of the above mentioned properties.

Furthermore, new developments of the existing PVD techniques by, i.e., introducing unbalanced magnetrons in reactive sputtering (S. Kadlec, J. Musil and W.-D. Munz in J. Vac. Sci. Techn. A8(3), (1990), 1318) or applying a steered and/or filtered arc in cathodic arc deposition (H. Curtins in Surface and Coatings Technology, 76/77, (1995), 632 and K. Akari et al. in Surface and Coatings Technology, 43/44, (1990), 312) have resulted in a better control of the coating processes and a further improvement of the intrinsic properties of the coating material.

With the invention of the PVD bipolar pulsed DMS technique (Dual Magnetron Sputtering) which is disclosed in DD 252 205 and U.S. Pat. No. 5,698,314, a wide range of opportunities opened up for the deposition of insulating layers such as $Al_2O_3$. Furthermore, this method has made it possible to deposit crystalline $Al_2O_3$ layers at substrate temperatures in the range 500° to 800° C. $Al_2O_3$ exists in several different phases such as $\alpha$ (alpha), $\kappa$ (kappa) and $\chi$ (chi) called the "$\alpha$-series" with hcp (hexagonal close packing) stacking of the oxygen atoms, and in $\gamma$ (gamma), $\theta$ (theta), $\eta$ (eta) and $\delta$ (delta) called the "$\gamma$-series" with fcc (face centered cubic) stacking of the oxygen atoms. The most often occurring $Al_2O_3$ phases in CVD coatings deposited on cemented carbides at conventional CVD temperatures, 1000°–1050° C., are the stable alpha and the metastable kappa phases, however, occasionally the metastable theta phase has also been observed. According to U.S. Pat. No. 5,698,314, the DMS sputtering technique is capable of depositing and producing high-quality, well-adherent, crystalline $\alpha$-$Al_2O_3$ thin films at substrate temperatures less than 800° C. The "$\alpha$-$Al_2O_3$" layers may partially also contain the gamma ($\gamma$) phase from the "$\gamma$-series" of the $Al_2O_3$ polymorphs. When compared to prior art plasma assisted deposition techniques such as PACVD as described in U.S. Pat. No. 5,587,233, the novel, pulsed DMS sputtering deposition method has the decisive, important advantage that no impurities such as halogen atoms, e.g., chlorine, are incorporated in the $Al_2O_3$ coating.

Conventional cutting tool material like cemented carbides comprises at least one hard metallic compound and a binder, usually cobalt (Co), where the grain size of the hard compound, e.g., tungsten carbide (WC), ranges in the 1–5 $\mu$m region. Recent developments have predicted improved tool properties in wear resistance, impact strength, hot hardness by applying tool materials based on ultrafine microstructures by using nanostructured WC-Co powders as raw materials (L. E. McCandlish, B. H. Kear and B. K. Kim, in Nanostructured Materials, Vol. 1, pp. 119–124, 1992). Similar predictions have been made for ceramic tool materials by for instance applying silicon nitride/carbide-based ($Si_3N$/SiC) nanocomposite ceramics and, for $Al_2O_3$-based ceramics, equivalent nanocomposites based on alumina.

With nanocomposite nitride/carbide and alumina hard coating materials, it is understood that for a multilayered coating, the thickness of each individual nitride (or carbide) and alumina layer is in the nanometer range between 3 and 100 nm, preferably between 3 and 20 nm. If a certain periodicity or repeat period of the metal nitride/carbide and alumina layer sequence is involved, these nanoscale, multilayer coatings have been given the generic name of "superlattice" films. A repeat period is the thickness of two adjacent metal nitride/carbide and alumina layers. Several of the binary nitride superlattice coatings with the metal element selected from Ti, Nb, V and Ta, grown on both single- and polycrystalline substrates have shown an enhanced hardness for a particular repeat period usually in the range 3–10 nm.

OBJECTS AND SUMMARY OF THE INVENTION

It is an object of this invention to avoid or alleviate the problems of the prior art.

It is further an object of this invention to provide a cutting tool for metal machining.

It is an aspect of the invention to provide a cutting tool comprising a body selected from the group consisting of sintered cemented carbide or cermet, ceramics and high speed steel and a thin, adherent, hard and wear resistant coating applied on the functioning parts of the surface of the body, said coating comprising a laminar, multilayered structure of refractory compounds in polycrystalline, non-repetitive form having the formula, $[(MLX/Al_2O_3)]_y$ where the alternating layers are MLX and $Al_2O_3$, the MLX sublayers comprise a metal nitride or a metal carbide with the metal elements M and L selected from the group consisting of Ti, Nb, Hf, V, Ta, Mo, Zr, Cr, W, Al and mixtures thereof, and the $Al_2O_3$ sublayers are crystalline $Al_2O_3$ of the alpha ($\alpha$)—and/or gamma ($\gamma$) phase, in said coating the sequence of individual layer thicknesses having no repeat period but being essentially aperiodic throughout the entire multilayered structure, the said individual MLX or $Al_2O_3$ layer thickness is between 0.1 and 30 nm, said thickness varies essentially at random, and y is a whole number such that the total thickness of said multilayered coating is between 0.5 $\mu$m and 20$\mu$m.

BRIEF DESCRIPTION OF THE DRAWINGS

The FIGURE is a schematic representation of a cross-section taken through a coated body of the present invention.

DETAILED DESCRIPTION OF THE PREFERRED EMBODIMENTS OF THE INVENTION

Figure 1:
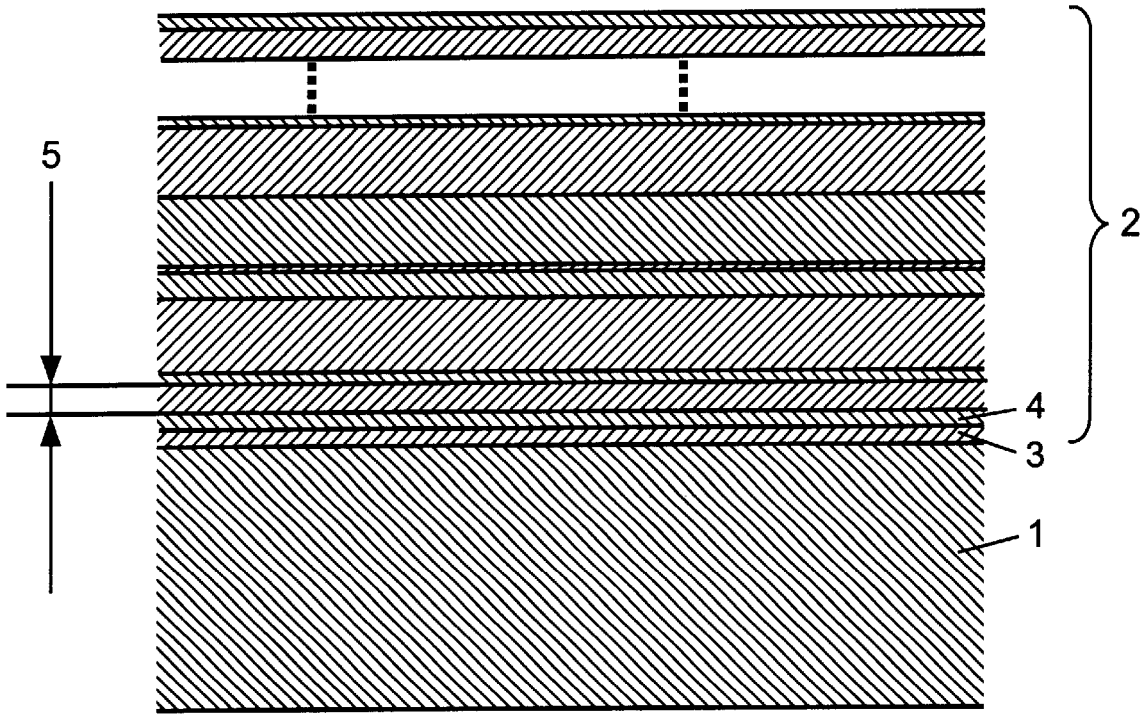

According to the present invention, there is provided a cutting tool for metal machining such as turning (threading and parting), milling and drilling comprising a body of a hard alloy of cemented carbide, cermet, ceramic or high speed steel, onto which a wear resistant, multilayered coating has been deposited. The shape of the cutting tool includes indexable inserts as well as shank type tools such as drills, end mills, etc. More specifically, the coated tool comprises a substrate of sintered cemented carbide body or a cermet, preferably of at least one metal carbide in a metal binder phase, or a ceramic body. The substrate may also comprise a high speed steel alloy. Said substrate may also be precoated with a thin single- or multilayer of TiN, TiC, TiCN or TiAlN with a thickness in the micrometer range according to the prior art. The coating is applied onto the entire body or at least the functioning surfaces thereof, e.g., the cutting edge, rake face, flank face and any other surface which participates in the metal cutting process.

The coated cutting tool according to the present invention exhibits improved wear resistance and toughness properties compared to prior art tools when used for machining steel or cast iron. The coating, which is adherently bonded to the substrate, comprises a laminar, multilayered structure of metal nitrides (or carbides) and crystalline alumina of the alpha ($\alpha$)- and/or- the gamma. ($\gamma$) phase, preferably of metal nitrides and crystalline $\gamma$-$Al_2O_3$, and has a thickness between 0.5 and 20 $\mu$m, preferably between 1 and 10 $\mu$m, most preferably between 2 and 6 $\mu$m. In the multilayered coating structure $(MLX/Al_2O_3)/(MLX/Al_2O_3)/(MLX/Al_2O_3)/(MLX/Al_2O_3)/\ldots$, the alternating layers are MLX and $Al_2O_3$ (see the Figure) where MLX comprises a metal nitride or a metal carbide with the metal elements M and L selected from the group consisting of titanium (Ti), niobium (Nb), hafnium (Hf), vanadium (V), tantalum (Ta), molybdenum (Mo), zirconium (Zr), chromium (Cr), tungsten (W), aluminum (Al) and mixtures thereof. In the coating, there is no repeat period of the thicknesses of the individual sublayers. The sequence of individual MLX and $Al_2O_3$ layers have thicknesses that are essentially aperiodic throughout the entire multilayer structure. Furthermore, the minimum individual layer thickness is between 0.1 and 1 nm but less than 30 nm, preferably less than 20 nm, most preferably less than 13 nm. The thickness of each individual layer does not depend on the thickness of an individual layer immediately beneath, nor does it bear any relation to an individual layer above said one individual layer. Preferred examples of the above described nanomultilayered coating structures are, e.g., when M=L, $TiN/Al_2O_3/TiN/Al_2O_3/TiN/Al_2O_3/TiN/\ldots$ or when L≠M, $TiAlN/Al_2O_3/TiAlN/Al_2O_3/TiAlN/Al_2O_3/TiAlN/\ldots$.

Referring to the Figure, there is shown a substrate 1 coated with a laminar, multilayered nitride/carbide and alumina coating 2 with the individual metal nitride (or carbide) layers being MLX 3 and the individual alumina layers 4, and an example of an individual layer thickness 5. The sequence of individual layer thicknesses being essentially aperiodic throughout the entire multilayer coating.

The laminar coatings above exhibit a columnar growth mode with no or very little porosity at the grain boundaries. The coatings also possess a substantial waviness in the sublayers which originates from the substrate surface roughness.

For a cutting tool used in metal machining, several advantages are provided by the present invention with nanostructured lamellae coatings deposited on substrates of hard, refractory materials such as cemented carbides, cermets and ceramics. In a lamellae coating of $(MLX/Al_2O_3)/(MLX/Al_2O_3)/\ldots$ on cemented carbides, the hardness of the coating is usually enhanced over the individual single layers of MLX and $Al_2O_3$ with a layer thickness on a $\mu$m scale simultaneously as the intrinsic stress is smaller. The first observation, enhanced hardness in the coating, results in an increased abrasive wear resistance of the cutting edge while the second observation of less intrinsic stress in the coating, provides an increased capability of absorbing stresses exerted on the cutting edge during a machining operation. Furthermore, the present coating gives the cutting edges of the tool an extremely smooth surface finish which, compared to prior art coated tools, results in an improved surface finish also of the workpiece being machined.

The laminar, nanostructured coatings according to the present invention can be deposited on a carbide, cermet, ceramic or high speed steel substrate either by CVD or PVD techniques, preferably by the PVD bipolar pulsed dual magnetron sputtering (DMS) technique, by successively forming individual sublayers on the tool substrate at a substrate temperature of 450°–700° C., preferably 550°–650° C., by switching on and off separate magnetron systems.

The principles, preferred embodiments and modes of operation of the present invention have been described in the foregoing specification. The invention which is intended to be protected herein, however, is not to be construed as limited to the particular forms disclosed, since these are to be regarded as illustrative rather than restrictive. Variations and changes may be made by those skilled in the art without departing from the spirit of the invention.

What is claimed is:

1. A cutting tool comprising a body selected from the group of sintered cemented carbide, cermet, ceramics and high speed steel, and a thin, adherent, hard and wear resistant coating applied on at least the functioning parts of the surface of the body, said coating comprising a laminar, multilayered structure of refractory compounds in polycrystalline, non-repetitive form having the formula, $[(MLX/Al_2O_3)]_y$ where the alternating layers are MLX and $Al_2O_3$, the MLX sublayers comprise a metal nitride or a metal carbide with the metal elements M and L selected from the group consisting of Ti, Nb, Hf, V, Ta, Mo, Zr, Cr, W, Al and mixtures thereof, and wherein the $Al_2O_3$ sublayers are crystalline $Al_2O_3$ of the gamma (γ) phase, in said coating the sequence of individual layer thicknesses having no repeat period but being essentially aperiodic throughout the entire multilayered structure, the said individual MLX or $Al_2O_3$ layer thickness is between 0.1 and 30 nm, said thickness varies essentially at random, and y is a whole number such that the total thickness of said multilayered coating is between 0.5 μm and 20 μm.

2. The cutting tool of claim 1 wherein said individual MLX or $Al_2O_3$ layer thickness is less than 20 nm.

3. The cutting tool of claim 2 wherein the MLX sublayers are composed of metal nitrides.

4. The cutting tool of claim 3 wherein the sublayers of the metal nitrides comprise one of: TiAlN and TiN.

5. The cutting tool of claim 3 wherein the sublayers of the metal nitrides are TiAlN.

6. The cutting tool of claim 1 wherein the individual layer thickness varies between 1 and 20 nm.

7. The cutting tool of claim 1 wherein the individual layer thickness varies between 2 and 13 nm.

8. The cutting tool of claim 1 wherein said coating has a total thickness of 1 to 10 μm.

9. The cutting tool of claim 8 wherein said coating has a total thickness of 2 to 6 μm.

10. The cutting tool of claim 1 wherein said tool body is a cemented carbide or a cermet.

* * * * *